US006581505B1

(12) United States Patent
Levell

(10) Patent No.: US 6,581,505 B1
(45) Date of Patent: Jun. 24, 2003

(54) PORTABLE BALLISTIC BARRICADE

(75) Inventor: Robert T. Levell, Cincinnati, OH (US)

(73) Assignee: Reliance Armor Systems, Inc., Cincinnati, OH (US)

( * ) Notice: Subject to any disclaimer, the term of this patent is extended or adjusted under 35 U.S.C. 154(b) by 0 days.

(21) Appl. No.: 09/911,245

(22) Filed: Jul. 23, 2001

(51) Int. Cl.[7] ..... F41H 1/00
(52) U.S. Cl. ..... 89/36.07; 89/36.01; 182/129
(58) Field of Search ..... 89/36.01, 36.02, 89/36.05, 36.07; 182/106, 129, 160, 230

(56) References Cited

U.S. PATENT DOCUMENTS

| | | | | |
|---|---|---|---|---|
| 36,781 A | | 10/1862 | Hunter | |
| 1,279,229 A | | 9/1918 | Bilan | |
| 3,968,857 A | | 7/1976 | Bryan | |
| 4,450,937 A | | 5/1984 | Broughton | |
| 4,574,918 A | * | 3/1986 | Marques | 182/164 |
| 5,086,872 A | | 2/1992 | Lin | |
| 5,377,577 A | * | 1/1995 | Bounkong et al. | 2/2.5 |
| 5,392,686 A | | 2/1995 | Sankar | |
| 5,441,126 A | | 8/1995 | Orrick | |
| 5,796,028 A | * | 8/1998 | Field et al. | 89/36.02 |
| 5,862,882 A | * | 1/1999 | Brady et al. | 182/129 |
| 6,161,462 A | * | 12/2000 | Michaelson | 102/303 |
| 6,161,605 A | * | 12/2000 | Pena | 160/105 |

* cited by examiner

*Primary Examiner*—Michael J. Carone
*Assistant Examiner*—Gabriel S. Sukman
(74) *Attorney, Agent, or Firm*—Wood, Herron & Evans, LLP

(57) ABSTRACT

A portable ballistic barricade comprises a ballistic shield blanket attached to a portable, collapsible ladder. The blanket has at least one removable ballistic panel operatively disposed therein, and the ladder and blanket may be quickly and easily collapsed together in order to be transported to different locations. The blanket may also be rapidly removed from the ladder and used to cover an explosive device.

2 Claims, 3 Drawing Sheets

PORTABLE BALLISTIC BARRICADE

FIELD OF THE INVENTION

This invention relates to shielding devices for protection against small arms projectiles and blasts.

BACKGROUND OF THE INVENTION

In law enforcement and military operations, it is desirable to protect personnel from projectiles such as bullets, fragmentation shrapnel and blasts which may come their way from criminal, terroristic, military or other armed threats or explosives. Frequently these threats may be concealed behind cover or concealment associated with buildings, barriers or structures encountered in raids, searches, warrant service, assault barricade incidents or the like. Where physical structures must be breached, it is also frequently necessary to have breaching equipment, such as ladders or other means, to facilitate human access over obstacles or spaces, both vertically and horizontally.

The need for both shielding against projectiles and blasts, as well as for portable ladders and the like, burdens personnel who are already laden with weaponry, munitions, radios, personal body armor, lights and other equipment. Moreover, there is also a need for equipment to facilitate entry into buildings.

Both shields and collapsible ladders are known. One such ladder is manufactured by Foldable Products International Inc. of Canada, marketed as a QUIKSTEP™ ladder, and used by the U.S. Army. This ladder is about six feet tall and may be collapsed into a compact condition which is the size of a briefcase and may be easily carried from place to place. Such a ladder is commonly used in fire and rescue operations because it is portable and may be easily stored in a compact, limited area. The QUIKSTEP™ ladder is also used in the military and law enforcement industries to scale obstacles like walls, to climb to the upper floors of a building quickly and safely even in remote locations, to traverse spaces, and for other movement where an elongated support is helpful.

When the QUIKSTEP™ ladder or other like collapsible ladders are used by law enforcement personnel in raids, warrant service, searches, arrests or the like, any bullets or projectiles fired from inside the building or structure may pass between the rungs or steps of the ladder and may injure the individual on the ladder. In addition, should a bomb or other blast explode from inside the building the projectiles resulting from the blast will pass between the rungs of the ladder and injure the individual on the ladder. Thus, while the ladder facilitates human movement, it does little to protect against projectiles and blasts.

Special Weapons and Tactics (SWAT) teams have been implemented in large and small cities alike throughout the world, in response to terrorism and criminal threats. In addition to other law enforcement personnel, SWAT teams need ladders to effectively accomplish their objectives. One of the more dangerous and difficult situations involving these teams is the approach to a structure such as a building in which may include armed parties are barricaded. Uncertainty of threats from heights such as the upper floors of a building are particularly dangerous.

U.S. Pat. No. 5,862,882 discloses a ballistic assault ladder and system for use by such SWAT teams in order to provide members of the SWAT team protection from projectiles. This patent discloses a rigid noncollapsible ladder and a rigid ballistic shield mounted to the front face of the ladder.

The rigid ballistic shield has a hole therethrough for the user to look through. It is formed of a material resistant to projectiles and the like such as, for example, KEVLAR™, SPECTRA™ or another similar material.

One difficulty with the ballistic assault ladder disclosed in U.S. Pat. No. 5,862,882 is that it is bulky and cumbersome. Because it is rigid and cannot be collapsed, it is difficult to transport the ballistic assault ladder from one location to another as is often necessary in the circumstances under which the ladder is utilized.

Therefore, it has been one objective of the present invention to provide a portable ballistic barricade which incorporates a lightweight, collapsible ladder which may be quickly and conveniently transported and assembled.

It has further been an objective of the present invention to provide a portable ballistic barricade incorporating a relatively impervious ballistic shield in combination with a portable, collapsible ladder.

SUMMARY OF THE INVENTION

To these ends, a preferred embodiment of the invention comprises a portable ballistic barricade made up of two elements: a portable, collapsible ladder and a ballistic blanket. As used herein, the term "ballistic blanket" refers to a non-rigid ballistic shield capable of stopping projectiles from small arms fire, personnel munitions and blast effects of the type which might be encountered in the instances noted above.

Any collapsible ladder may be used in accordance with the present invention. However, one specific ladder which has proven satisfactory is the QUIKSTEP™ ladder manufactured by Foldable Products International Inc. of Canada. The ladder has a plurality of slots therein adapted to receive straps of the blanket in order to removably secure the blanket to the ladder.

The blanket of the present invention is removably secured to the ladder. A plurality of straps which form part of the blanket are passed through the slots in the ladder rails, wrapped around the ladder and secured, thus forming the one-piece portable ballistic barricade, and serving also to maintain the ladder in an extended condition. One side of the blanket of the present invention has a plurality of pockets adapted to store and house additional straps. Such straps comprise stretcher straps which are used to secure an injured person to the barricade in stretcher-like fashion.

The blanket includes an external cover which is preferably made of nylon but may be of other suitable materials. Inside the cover one or more ballistic panels are inserted and form an integral part of the blanket. These panels are held in the blanket by stitching, discrete pouches, or any other suitable manner.

The blanket is collapsible along with the ladder, therefore the entire ballistic barricade may collapse into a size smaller than a suitcase in less than five seconds, for easy transport. In addition, once at the desired location the portable ballistic barricade may be quickly and easily assembled by deploying or erecting the ladder, causing the blanket to expand to its fully deployed position along with the ladder.

If desired, the portable ballistic barricade may be carried by personnel as a shield. The barricade then constitutes instant cover should the users be caught in the open under fire. The ladder is preferably six feet in length, and the barricade provides cover for numerous officers in a queue or "stick."

Another use of the present invention is as a bomb blanket should a suspicious device be encountered. In this event, the blanket may be quickly separated from the ladder and the blanket placed over the bomb or suspicious package.

Yet another use of the portable ballistic barricade of the present invention is as a stretcher or litter. Elongated straps located in the pockets of the blanket may be undone and wrapped around an injured individual, who is placed on the blanket side of the barricade and supported in part by the ladder. Once strapped onto the barricade, the injured individual may be quickly and easily transported. To facilitate transport, separate handles from a tool kit, not part of this invention, may be secured to the ladder.

The blanket has a relatively large footwell bag at the bottom thereof which opens outwardly away from the ladder and is adapted to receive the feet of an individual lying on the barricade when the barricade is used as a stretcher. Use of this footwell bag enables one person to quickly remove an injured or incapacitated individual from a threat area, the feet being supported in the footwell at a lower end while the upper end is pulled by the operator. The blanket is quickly and easily removable from the ladder and may be rolled into the footwell bag and secured therein with fasteners in order to quickly and easily transport the blanket separate from the ladder.

The blanket of the present invention has at least one, preferably removable ballistic panel operatively disposed therein for protection against projectiles. Any number of ballistic panels of numerous materials may be incorporated into the blanket of the present invention. The ballistic panels provide protection and cover against small arms fire and blasts.

By incorporating different materials of differing thicknesses into the interior of the blanket of the present invention, different results may be achieved as desired. Thus, a custom-made product for a specific use may be accomplished. Also, the ballistic panel can be removed from the blanket and retained for cover purposes while the blanket cover is used with the ladder as a stretcher.

These and other objectives and advantages of the present invention will be more apparent from the following detailed description and from the drawings.

DETAILED DESCRIPTION OF THE DRAWINGS

Figure 1:
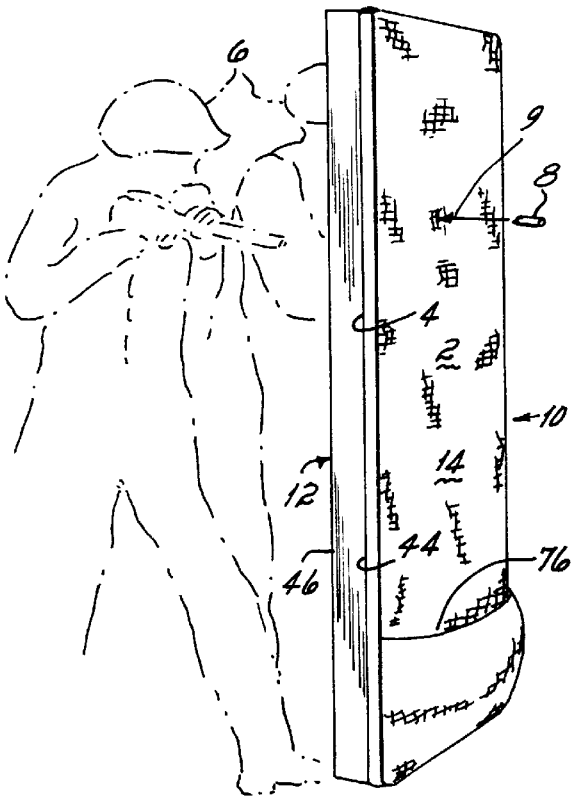
FIG. 1 is a perspective view of the portable ballistic barricade of the present invention being used as a shield.

Referring to the drawings, and particularly to FIG. 1, there is illustrated a portable ballistic barricade 10 of the present invention being used as a shield. The portable ballistic barricade 10 comprises a collapsible ladder 12, illustrated in detail in FIGS. 5 and 6, and a collapsible blanket 14 secured to the collapsible ladder 12, as illustrated in detail in FIG. 4.

Figure 4:
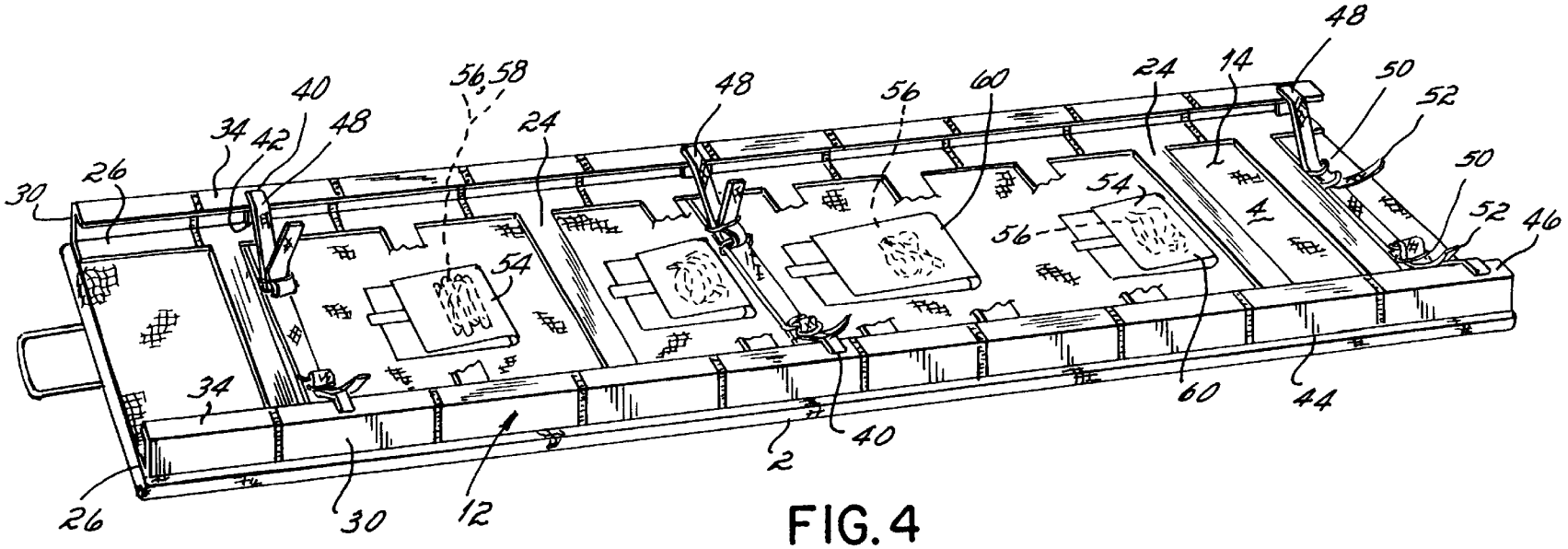
FIG. 4 is a perspective view of the rear side of the portable ballistic barricade of the present invention in an erected condition.
Figures 5, 6:
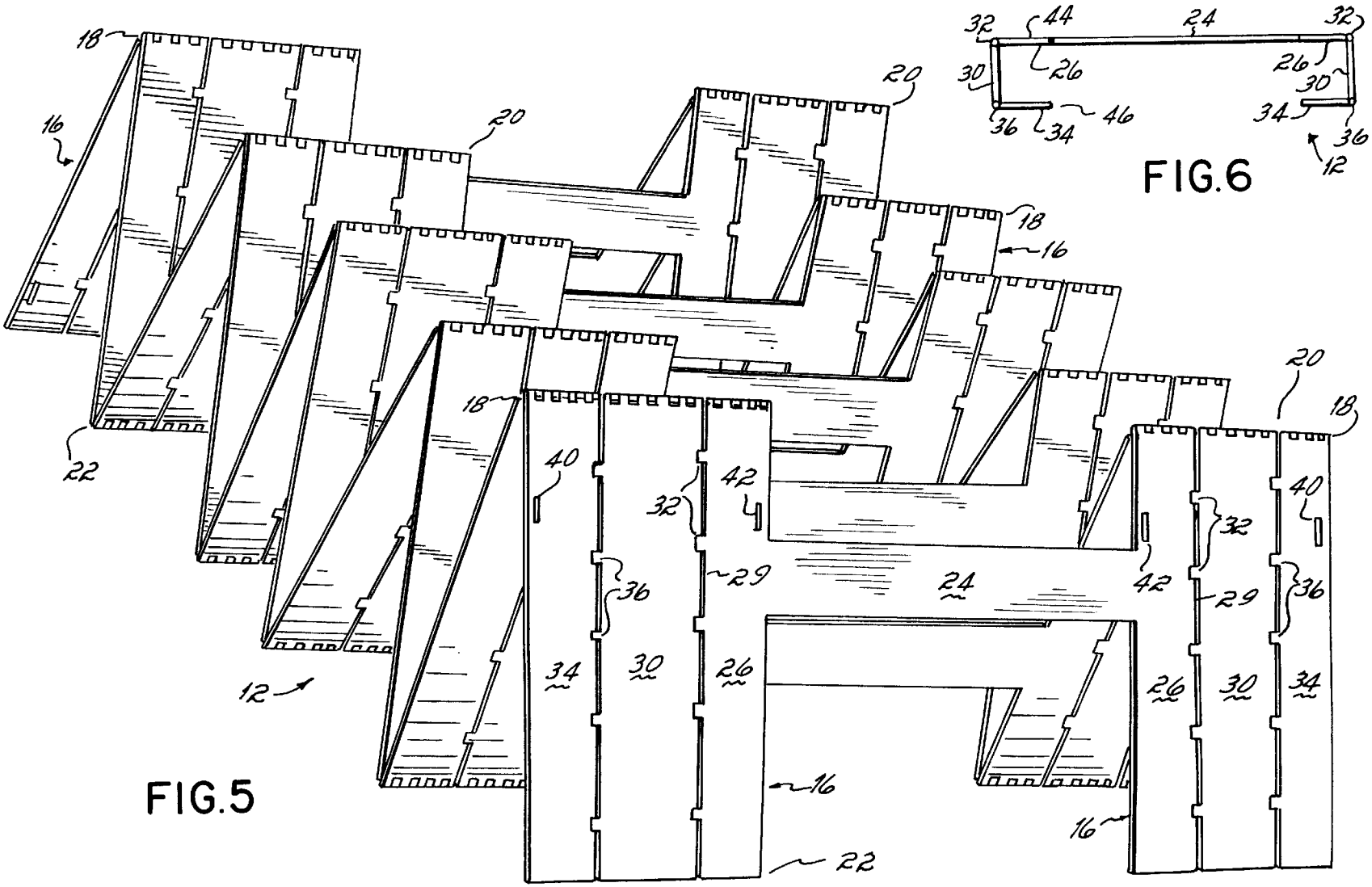
FIG. 5 is a perspective view of the QUIKSTEP™ collapsible ladder component of the present invention, shown in a developed, partially collapsed condition.
FIG. 6 is a top elevational view of the ladder of FIG. 5 in an assembled condition, but without the blanket.

The collapsible ladder 12 is illustrated in detail in FIG. 5. Although any particular collapsible ladder may be used in accordance with the present invention, the QUIKSTEP™ ladder manufactured by Foldable Products International Inc. of Canada is illustrated and described. This ladder is movable between a collapsed position in which it is the size of a briefcase or suitcase and a fully deployed position as illustrated in FIG. 4.

Referring to FIG. 5, the collapsible the QUIKSTEP™ collapsible ladder 12 comprises a plurality of planar sections 16 transversely hingedly secured together with hinges 18 in accordion-like fashion. The hinges 18 are alternatively located along the upper and lower edges 20,22 of the planar sections. Each planar section 16 is generally in the shape of an "H." On each side of the ladder rung 24 is a first portion 26. Each generally planar section 16 further has a pair of central portions 30 hingedly joined to outer edges 29 of the first portion 26 with hinges 32. Each central portion 30 is hingedly connected to a third outer portion 34 along hinge 36. Thus, each generally planar section 16 comprises two inner, central and outer portions 26, 30 and 34, and a rung 24. The inner portions 26 are integrally joined to the rung 24.

As illustrated in FIG. 6, in order to maintain the ladder in an erected, fully deployed position, each section 16 of the ladder 12 is bent at each side into a C-shaped configuration along hinges 32 and 36.

Each of the outer portions 34 of the ladder has one or more slots 40 therethrough for receiving a strap from the blanket 14 in a manner described below. Similarly, each of the inner portions 26 of the ladder has slots 42 therein for the same purpose.

In operation, the ladder is movable from a compact position to an expanded position by unfolding the sections 16 along hinges 18 until the entire ladder is generally planar. Then the central and outer portions 30,34 of the ladder sections 16 are bent inwardly into a generally C-shapes as illustrated in FIG. 6 along hinges 32 and 36.

Figure 2:
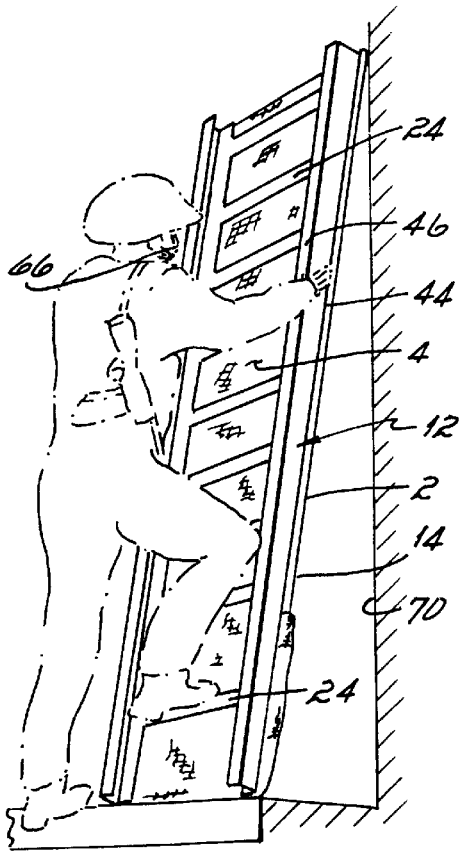
FIG. 2 is a perspective view of the portable ballistic barricade of the present invention being used to scale a wall.

As illustrated in FIG. 4, when erected the ladder 12 has a front face 44 against which the blanket 14 abuts and a rear face 46, facing directly upwardly in FIG. 4, and defined by outer panels 34. This rear face 46 is directed toward the user as illustrated in FIGS. 1 and 2 when the portable ballistic barricade is used as a shield or climbing device, respectively. The inner portions 26 of the ladder sections 16 and rungs 24 form part of the forward side or front face 44 of the ladder.

Figure 4A:
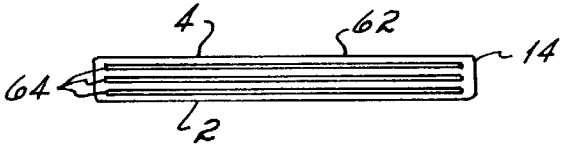
FIG. 4A is a schematic view of the interior of the blanket of the present invention.

Referring to FIGS. 4 and 4A, the blanket 14 will be described in more detail. The blanket 14 has a generally planar front surface 2 and a rear surface 4 which abuts against the inner portions 26 and rungs 24 of the ladder sections 16. The blanket 14 has three securement straps 48. Each securement strap 48 has four metal hoops 50 which are used to secure the respective end portions 52 of the straps 48 in order to prevent the strap 48 from becoming undone. The end portions 52 of each securement strap 48 are passed through the slots 40,42 in the portions 34,26 of the ladder 12 before being passed through the hoops 50 in order to secure the blanket 14 to the ladder 12.

The rear surface 4 of the blanket 14 has a plurality of pockets 54 secured thereto. Each pocket 54 contains a pair of transversely extending stretcher straps 56, illustrated in FIG. 3, and a longitudinally extending additional strap 58 which is adapted to be wrapped around one of the rung sections 24 of the ladder when the ladder is erected. Each pocket 54 has a cover 60 secured thereto with a hook-andloop-type fastener or any other type of fasteners. Thus, when not in use, the straps 56 and 58 may be placed inside the pocket 54 and the cover 60 placed over the pocket in order to close the pocket.

As illustrated in FIG. 4A, the blanket includes a blanket cover 62 surrounding one or more layers of ballistic panels 64. The blanket cover 62 is preferably made of nylon but may be manufactured of NOMEX™, CORDURA™ or any other suitable material. Each ballistic panel 64 preferably extends the length of the blanket but may be of any height or width. Although three ballistic panels 64 are illustrated in FIG. 4A, any number may be used in accordance with the present invention. In addition, any of numerous materials may be used to make up the ballistic panel 64 of the present invention, such as, for example, KEVLAR™, SPECTRA™ or other similar materials. One type of material which has proven satisfactory is ten layers of GOLDFLEX™, which is a nonwoven aramid. Another type of material which has proven satisfactory is fourteen layers of TWARON™, which is a woven aramid. The TWARON™ fibers may be woven into different deniers, for example 500 denier, 840 denier, or 1000 denier. Various configurations of materials and numbers of layers can be used as desired.

Figure 3:
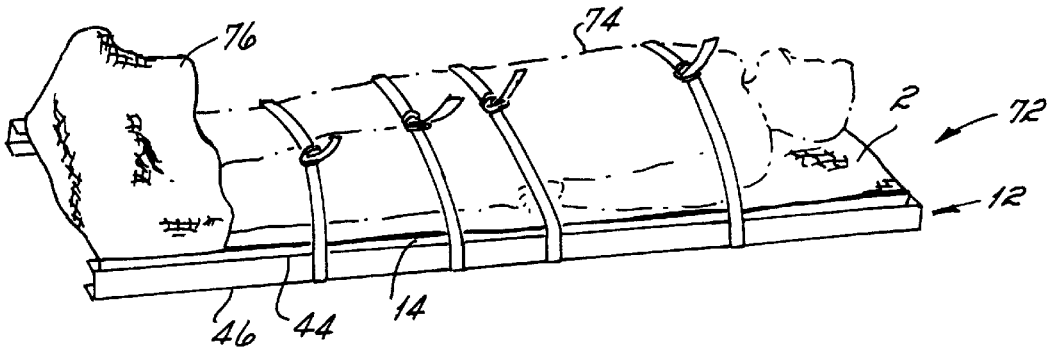
FIG. 3 is a perspective view of the portable ballistic barricade of the present invention being used as a stretcher.

FIGS. 1–3 illustrate three different uses of the portable ballistic barricade 10 of the present invention. In FIG. 1 the portable ballistic barricade is used as a portable shield in order to provide ballistic cover to prevent persons 6 from being hit by projectiles 8 moving in the direction of arrow 9.

FIG. 2 illustrates a person 66 climbing the erected portable ballistic barricade 10 of the present invention in order to go over a wall 70 or enter a building.

FIG. 3 illustrates an alternative use of the present invention. In this use the portable ballistic barricade may be used as a stretcher or litter 72. An injured person 74 may be placed on top of the front surface 2 of the blanket 14 and his or her feet inserted into a footwell bag 76 located at the bottom of the blanket. The footwell bag 76 extends forwardly from the front surface 2 of the blanket 14. Lastly, the stretcher straps 56 may be placed over the person 74 and secured in a conventional manner in order to secure the person to the portable ballistic barricade. Then with or without the use of removable handles, another person may remove the injured individual 74 from the site to a safer location.

Thus, the portable ballistic barricade of the present invention may be quickly and conveniently collapsed and transported to a desired location. In addition, the portable ballistic barricade may be used as a ladder, a shield or a stretcher, depending upon the circumstances.

While I have described one preferred embodiment of the present invention, other changes and modifications known to those skilled in the art may be made without departing from the spirit of this invention. Therefore, I do not intend to be limited except by the scope of the following claims.

I claim:

1. A portable ballistic barricade comprising:

a foldable ladder, a blanket secured to the foldable ladder, and at least one ballistic panel operatively disposed within said blanket, and wherein said blanket has a footwell bag at the bottom thereof to receive the feet of a person lying on the barricade.

2. A portable ballistic barricade comprising:

a collapsible ladder erected in an extended position, a blanket secured to the collapsible ladder, and at least one ballistic panel operatively disposed within said blanket; and wherein said blanket has a footwell bag at the bottom thereof to receive the feet of a person lying on the barricade.

* * * * *